US007328693B2

(12) United States Patent
Kempf

(10) Patent No.: US 7,328,693 B2
(45) Date of Patent: Feb. 12, 2008

(54) REVERSE DRAW TECHNOLOGY ARCHERY

(76) Inventor: James J. Kempf, 3201 12th Ave., Coralville, IA (US) 52240

( * ) Notice: Subject to any disclaimer, the term of this patent is extended or adjusted under 35 U.S.C. 154(b) by 22 days.

(21) Appl. No.: 10/942,264

(22) Filed: Sep. 16, 2004

(65) Prior Publication Data

US 2006/0054150 A1 Mar. 16, 2006

(51) Int. Cl.
*F41B 5/12* (2006.01)
*F41B 5/10* (2006.01)

(52) U.S. Cl. ..... 124/25; 124/25.6

(58) Field of Classification Search ..... 124/23.1, 124/25, 25.6

See application file for complete search history.

(56) References Cited

U.S. PATENT DOCUMENTS 2,100,317 A * 11/1937 Hickman ..... 124/23.1
2,957,470 A * 10/1960 Barna ..... 124/23.1
3,238,935 A * 3/1966 Stanaland ..... 124/23.1
3,515,113 A * 6/1970 Lawrence ..... 124/27
4,722,317 A * 2/1988 Hartwig ..... 124/25.6
4,976,250 A * 12/1990 Jeffrey ..... 124/25
5,630,405 A * 5/1997 Nizov ..... 124/25
6,267,108 B1 * 7/2001 McPherson et al. ..... 124/25
6,460,528 B1 * 10/2002 Gallops, Jr. ..... 124/25

* cited by examiner

*Primary Examiner*—John A. Ricci
(74) *Attorney, Agent, or Firm*—Brett Trout

(57) ABSTRACT

The nature of the current invention is an archery device that uses what I claim as Reverse Draw Technology. In essance, what this is, is pulling the launch string of a bow or crossbow in the opposite direction that it is pulled in all prior art. Pulling the launch string into the curve of the opposing limbs, instead of away from them, allows for a longer power stroke, thus increasing performance and allowing, if so chosen, a lower draw weight, which translates to less noise at the same arrow speed. Arrow speed is determined by the force required to pull the launch string from an at rest position to the ready to fire position, and the distance the string is pulled. This distance is called the power stroke. By increasing the power stroke and decreasing the drawing force, comparable arrow speed is achieved with much less noise and effort on the part of the archer.

3 Claims, 10 Drawing Sheets

REVERSE DRAW TECHNOLOGY ARCHERY

CROSS REFERENCE TO RELATED APPLICATIONS

U.S. Pat. No. 6,267,108 McPherson
U.S. Pat. No. 6,460,528 Gallops, Jr.
U.S. Pat. No. 5,553,596 Bednar

STATEMENT REGARDING FEDERALLY SPONSORED RESEARCH OR DEVELOPMENT

Not Applicable

REFERENCE TO SEQUENCE LISTING

Not Applicable

BACKGROUND OF INVENTION

Archery equipment has long been used for hunting wild game for food, as well as recreation. The original style long bow, or recurve bow, consists of specially fabricated, long, narrow, typically wood body that has a central handle for gripping and opposing ends of the limbs that extend away from the central handle, connected at the ends by a taught string. The string create a force to be built and stored in the limbs. When an archer places an arrow in the center of the string and pulls back on the string and arrow, this force of energy is increased relative to the distance pulled. When the archer releases the arrow, the stored energy is released as the limbs return to their original position and propel the arrow forward. While this was an effective way to hunt for centuries, it took a great deal of time to learn the art and become proficient and accurate. A regular type bow was also limited in effective range by the strength of the archer.

Later, the weapon to end all wars was created: the crossbow. The crossbow essentially took the design of a regular bow and mounted it horizontally and perpendicular to a rail and stock which held a trigger mechanism, or string release. The crossbow allowed the archer to pull back the string and load the projectile, called a bolt, and remain in a "ready to fire" position until the appropriate time. This weapon, though easier to learn how to shoot, had many drawbacks. Due to size limitations, the limbs on a crossbow were much shorter than those of a regular bow. Because of the shorter limbs, they had to be much stiffer, and they required much more strength to pull back to get the same speed of the bolt as their regular bow counterparts. This increased force also generated much more noise. Another drawback was the fact that they also had a much shorter power stroke, or the distance the string is engaged to the bolt while releasing the stored energy of the limbs.

In modern day archery, there are two types of crossbows, compound and recurve. The recurve type is modeled after the centuries old recurve bow mounted horizontally. The compound crossbow is modeled after the compound bow, having cams on the ends of the limbs to help generate force. Both of these styles of crossbows typically require 150# to 225# drawing force to pull back the string, and are extremely loud for archery hunting equipment. In all prior art, including U.S. Pat. No. 6,267,108 McPherson, U.S. Pat. No. 6,460,528 Gallops, Jr., high noise levels and extreme draw forces are still a great issue. In U.S. Pat. No. 5,553,596 Bednar tried to address noise levels by creating a damping system to mount the limbs, but with little effect.

Though many people believe that crossbows are more lethal than conventional bows, this is not the case. Because of the extreme noise level created when the crossbow is fired, and the fact that an bolt is flying much slower than the speed of sound, the noise is heard by the game animal before the bolt reaches it, giving the animal time to react. Thus the louder the weapon, the less effective range it has. To try to compensate for this fact, manufacturers are left to try and increase speed by increasing the poundage force, all the while increasing the noise level.

As with conventional bows and crossbows, the string is pulled away from the generally concave area between the limbs, away from the riser and limbs. Because of these design mechanics, bows and crossbows are limited in stoke length due to usable size restrictions. It would be very easy produce a crossbow that had a much longer power stroke, but it would not be usable in the hunting world because of it being so massive. The invention disclosed in this filing answers all of the above described inherent problems of prior art crossbows and bows. One must first understand the basic and general rules of physics related to bows and arrows: For any given bow of any poundage rating, if the arrow weight is the same on all tests, the greater the length of the power stroke, the faster the arrow will fly. To compensate for a shorter power stroke, the poundage rating must be increased to offset this decrease.

BRIEF SUMMARY OF THE INVENTION

For purposes of defining some of the terms used in this disclosure and referring to prior art, I have submitted the following Prior art of a recurve bow has the launch string drawn away from the limbs of the bow, which is away from the generally concave area between the opposing limbs Prior art of a compound bow has the launch string drawn away from the riser and away from the generally concave area between the opposing limbs Prior art of a recurve crossbow has the launch string drawn away from the limbs of the crossbow, which is away from the generally concave area between the opposing limbs Prior art of a compound crossbow has the launch string drawn away from the riser and away from the generally concave area between the opposing limbs Stroke is defined as the distance the string travels on the plane of the arrow from a ready to fire position to a resting position, or the distance the launch string is actually pushing the arrow or bolt.

There is a formula for determining arrow speed on any given bow or crossbow. A simple explanation of this is as follows If identical arrows are used for all trials, said arrow that is launched from a bow that has a 50# rating and a 20" power stroke will be faster than the same arrow shot from a 50# bow with a 19" power stroke. If the power stroke and the arrow weight are to be the constants, then a 55# bow will shoot an arrow faster than a 50# bow. And finally, if power stoke and bow draw force are the constants, then a lighter arrow will launch faster than a heavier arrow.

With all of the above examples, the higher the pull rating that the bow or crossbow has, the more stored energy it will have, elevating the noise levels accordingly.

A brief summary of the current invention is an archery device that has a launch string that is pulled towards the riser, or mid section, and into the generally concave area between the opposing limbs of the bow or crossbow. This design greatly increases performance of arrow or bolt speed compared to prior art by increasing the length of the power stroke. In all prior art, the distance between the riser and the launch string, called brace height, when the bow was in the at rest position, was not included in the power stroke. An example of this on a cross bow would be as follows:

If a constant shooting rail length of 20" is used, where one end of said rail the front end, and the opposing end is the latch and trigger assembly end, in all prior art the riser is fastened to the front end of the shooting rail. Using a brace height for prior art crossbows of 8" leaves a power stroke of 12" In the current invention, with a shooting rail length of 20" and the riser mounted as illustrated, the launch string is now at the front end of the shooting rail, thus able to utilize the full shooting rail for a power stroke of 20".

By increasing the power stroke in this manner, much less draw force is required to achieve the same performance, or even greater performance can be achieved by using the same draw force as would be used in the crossbow described in the first 2 sentences of paragraph 16.

DETAILED DESCRIPTION OF THE INVENTION

Figure 1:
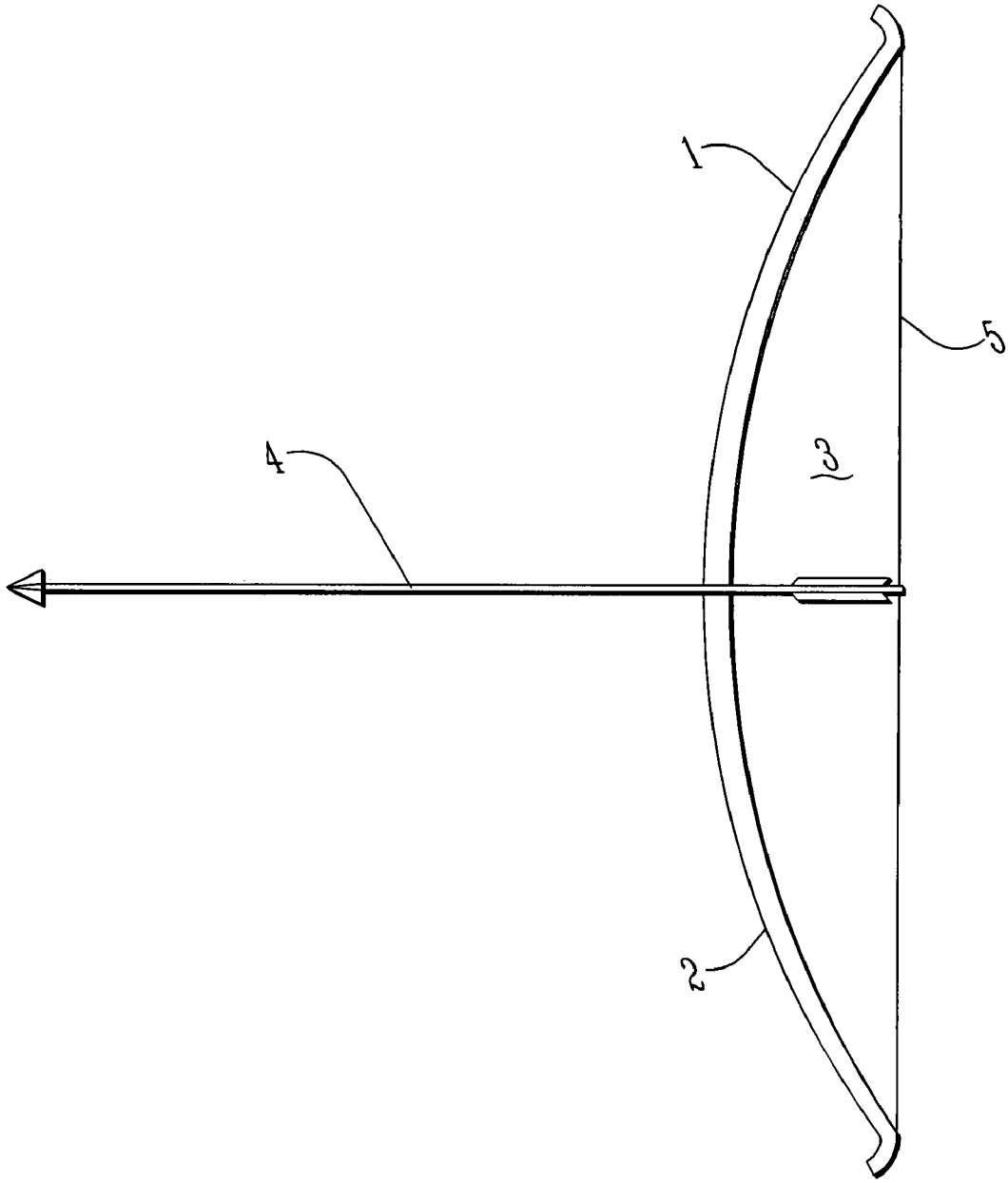
FIG. 1 is a side view of a traditional recurve bow and arrow in the at rest position
Figure 2:
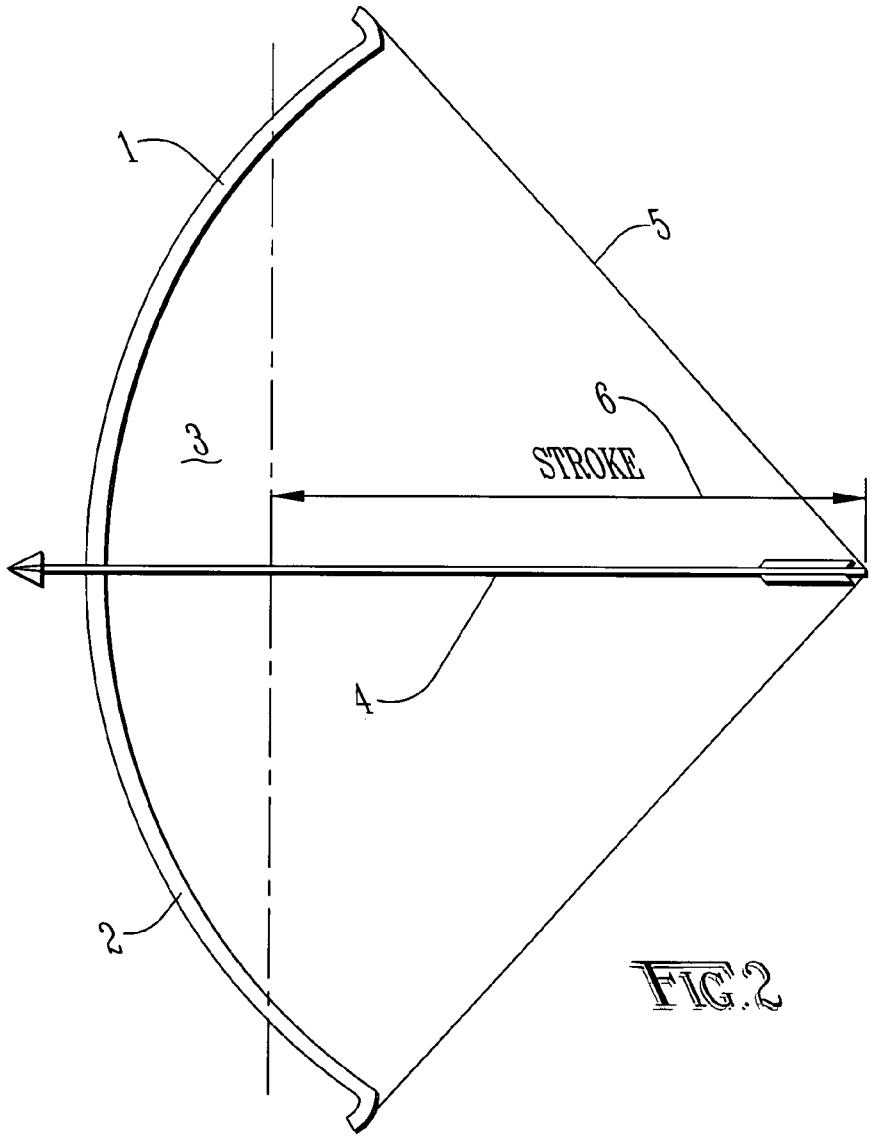
FIG. 2 is a side view of a traditional recurve bow and arrow in the ready to fire position

Referring to the drawings, FIG. 1 shows the side view of a typical recurve bow having an upper limb (1) and a lower limb (2) joined at opposing ends by a launch string (5). An arrow (4) is attached to the launch string (5) midway on said string by a knock. An archer would grasp the bow midway between the upper limb (1) and the lower limb (2) and at the arrow knock and pull said launch string (5) away from the generally concave area (3) between said limbs into a ready to fire position as shown in FIG. 2. The distance that the arrow (4) has traveled from its most rear position (FIG. 2) forward to the at rest position (FIG. 1) is called the power stroke (6). The greater this distance is with all other factors being equal, such as arrow weight and force required to pull back the launch string (5), the faster the arrow will fly.

Figure 3:
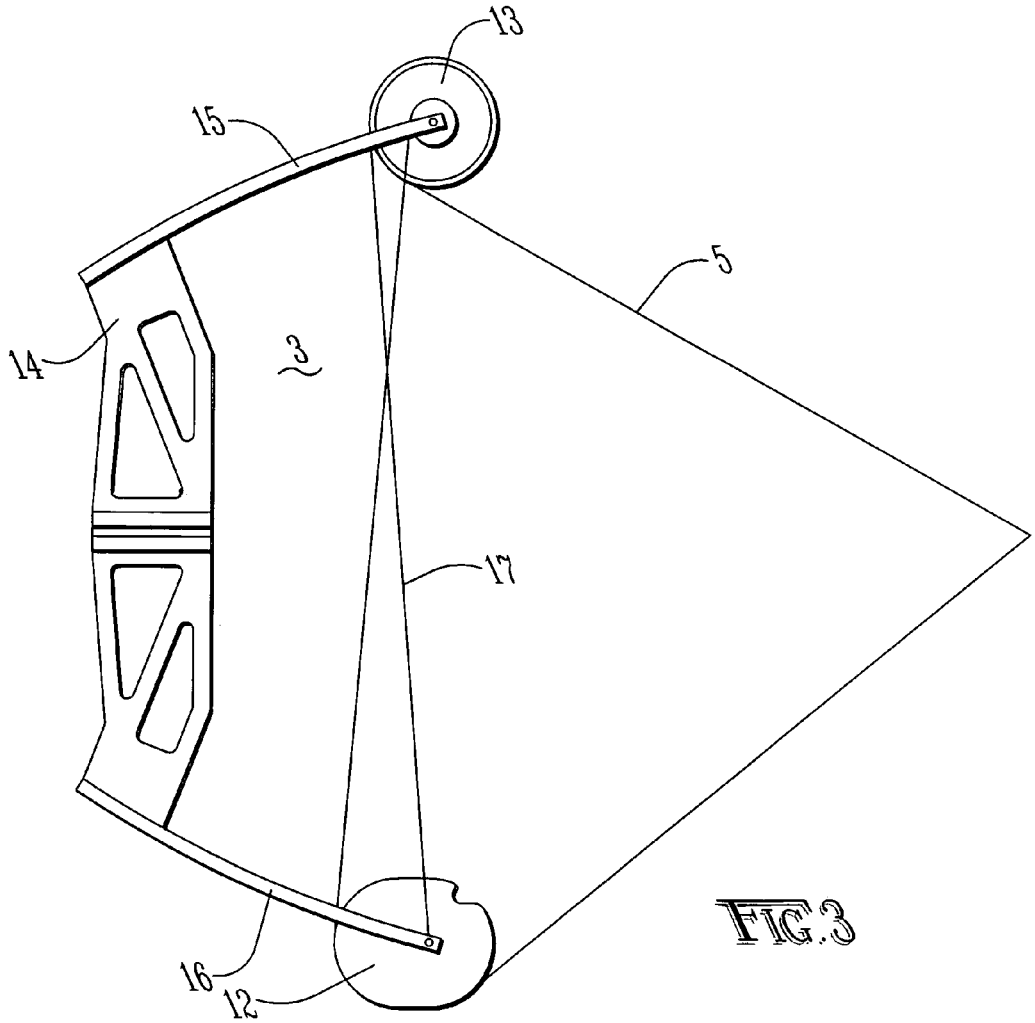
FIG. 3 is a side view of modern single cam compound bow in the ready to fire position without an arrow

Referring now to FIG. 3, this is a side view of a typical single cam compound bow, in the ready to fire position, consisting of an upper limb (15) and a lower limb (16) that are attached to opposing ends of a riser (14). At the outer ends of said limbs are attached a cam (12) and an idler wheel(13) that are connected by a launch string (5) and cables (17). The archer would grasp the riser (14) and the launch string (5) midway and then pull said launch string away from the riser (14) and away from the generally concave area (3) between the opposing limbs.

Figure 4:
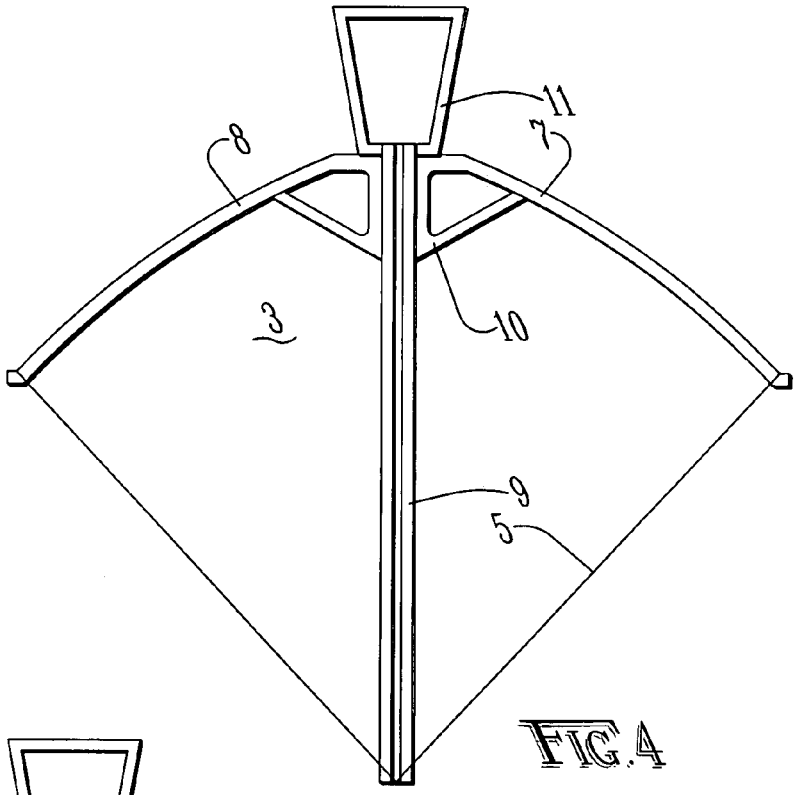
FIG. 4 is a partial top view of a recurve style crossbow in the ready to fire position. As most stocks for crossbows are the same, it has been eliminated from this drawing.

FIG. 4 is a partial top view of a recurve crossbow having a right limb (7), and a left limb(8) connected by a riser (10) at the inner ends of said limbs, and the out ends of said limbs are connected to each other by a launch string (5). Said riser (10) is fastened to the outer end of a shooting rail (9). The archer inserts his foot in the foot stirrup (11) and pulls the launch string (5) away from the riser and generally concave area (3) between the opposing limbs to the opposite end of the shooting rail (9) and engages the sting into a latch and trigger mechanism. Again the distance that the launch string travels from the ready to fire position to the at rest position is called the power stroke (6)

Figure 5:
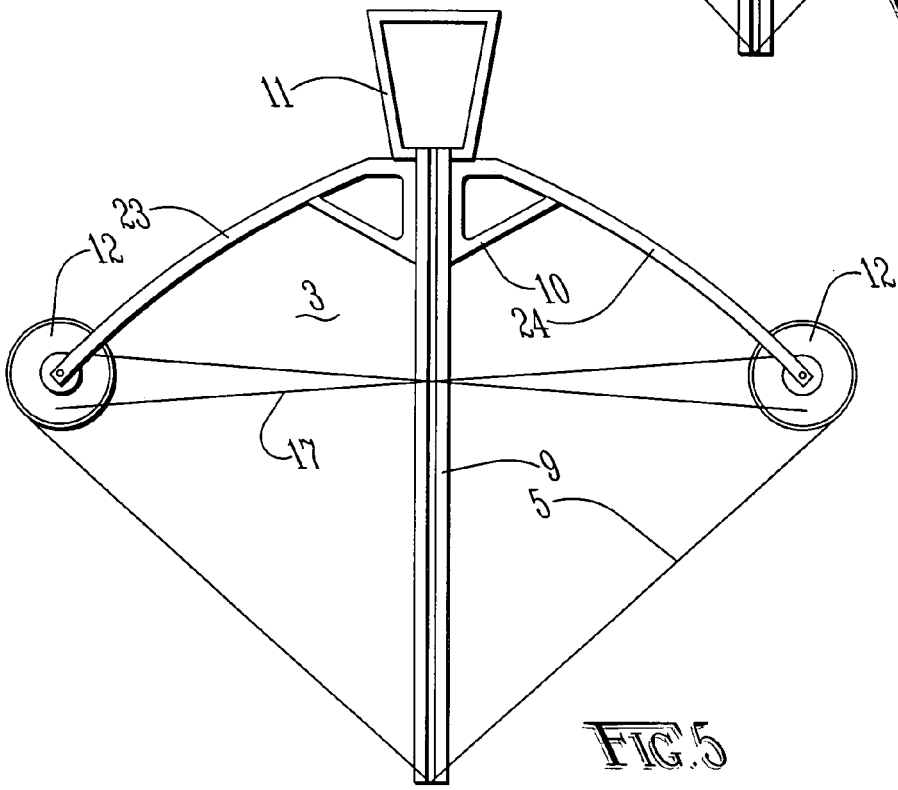
FIG. 5 is a partial top view of a compound crossbow in the ready to fire position. As most stocks for crossbows are the same, it has been eliminated from this drawing

FIG. 5 is a partial top view of a compound crossbow in the ready to fire position having a right limb (24) and a left limb (23) connected by a riser (10) at the inner ends of said limbs, and the outer ends of said limbs are connected to each other by cams (12), a launch string (5), and cables (17). The riser (10) is fastened to the outer end of the shooting rail (9). The archer inserts his foot in the foot stirrup (11) and pulls the launch string (5) away from the riser and the generally concave area (3) between the opposing limbs to the opposite end of the shooting rail (9) and engages said string into a latch and trigger assembly.

Figure 6:
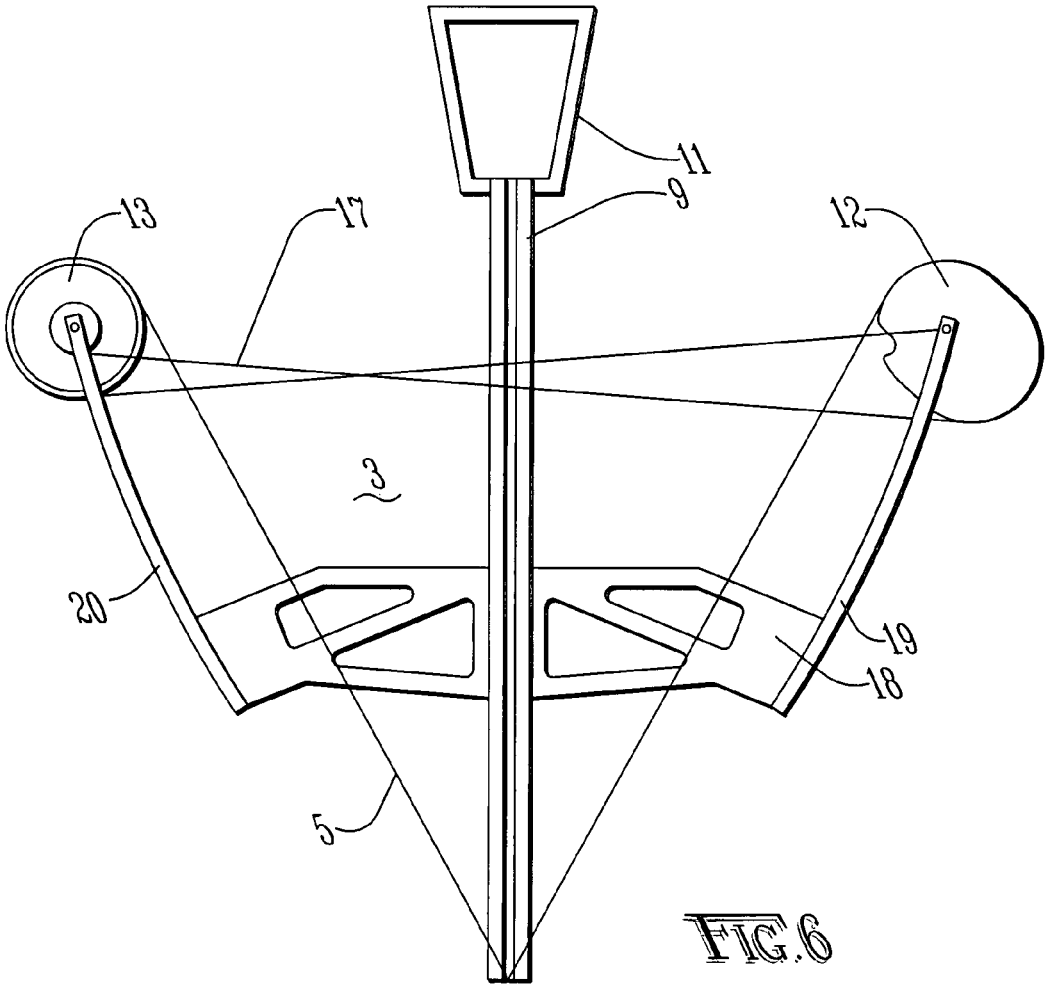
FIG. 6 is a partial drawing of the current invention in the ready to fire position. As most stocks for crossbows are the same, it has been eliminated from this drawing.

FIG. 6 is a partial top view of the current invention in the ready to fire position. In all forms of prior art, the riser (10) is at the front end of the crossbow, while the launch string (5) is oriented reward of said riser. In the current invention, this is just the opposite. The right limb (19) and the left limb (20) are connected at their inner ends to a riser (18). Said riser is not connected to the outer end of the shooting rail(9), it may be connected to the shooting rail (9) at a variety of points between the opposing ends of said rail. The outer ends of the limbs (19) and (20) have a cam(s) (12)and or an idler wheel (13) that are connected by a launch string (5) and cable(s) (17). The archer inserts his foot in the foot stirrup (11) and pulls the launch string (5) TOWARDS the riser (18) and INTO the generally concave area (3) between the opposing limbs and engages said string into a latch and trigger mechanism. Because of this configuration, the crossbow of the current invention will have a longer power stroke (6) than any prior art crossbow with the same length shooting rail (9). Thus, a longer stroke requires less poundage to achieve the speed, which in turn equals less noise.

Figure 7:
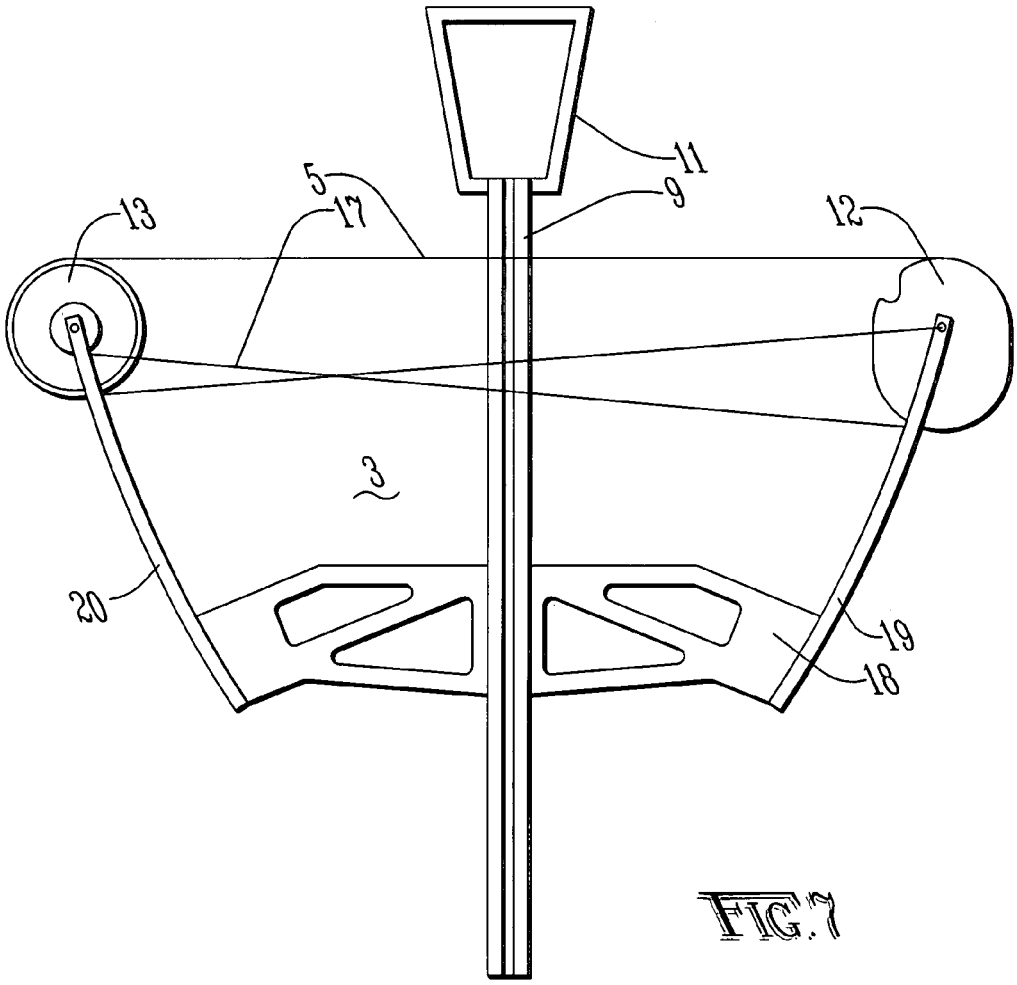
FIG. 7 is a partial top view of the current invention in the at rest position. As most stocks for crossbows are the same, it has been eliminated from this drawing.

FIG. 7 is a partial top view of the current invention in the at rest position.

Figure 8:
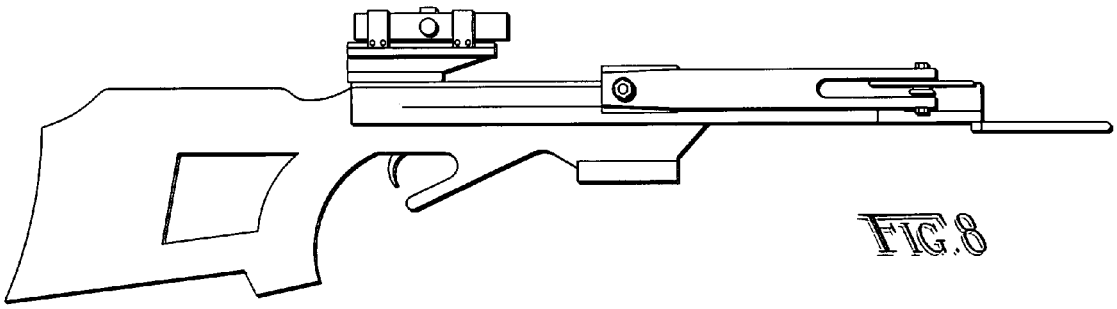
FIG. 8 is a right side view of the current invention.
Figure 9:
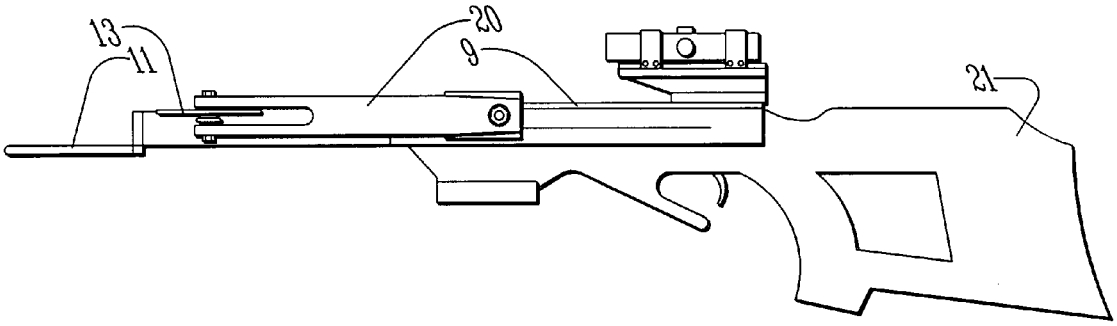
FIG. 9 is a left side view of the current invention

FIG. 8 and FIG. 9 are side views of the current invention as shown in FIGS. 6 and 7 with the addition of a typical gun style stock (21)

Figure 10:
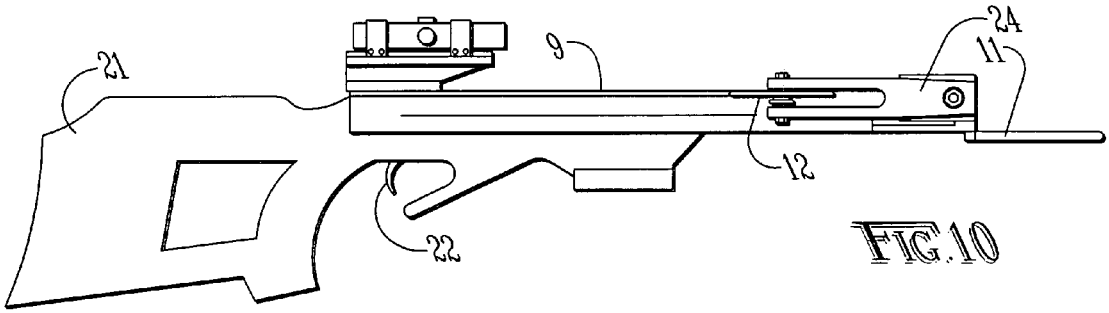
FIG. 10 is a right side view of a typical compound crossbow
Figure 11:
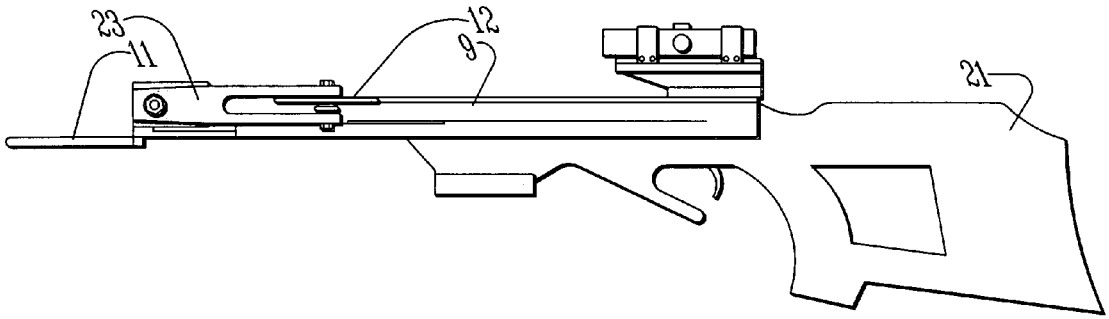
FIG. 11 is a left side view of a typical compound crossbow.

FIG. 10 and FIG. 11 are side views of typical prior art compound crossbows.

Figure 12:
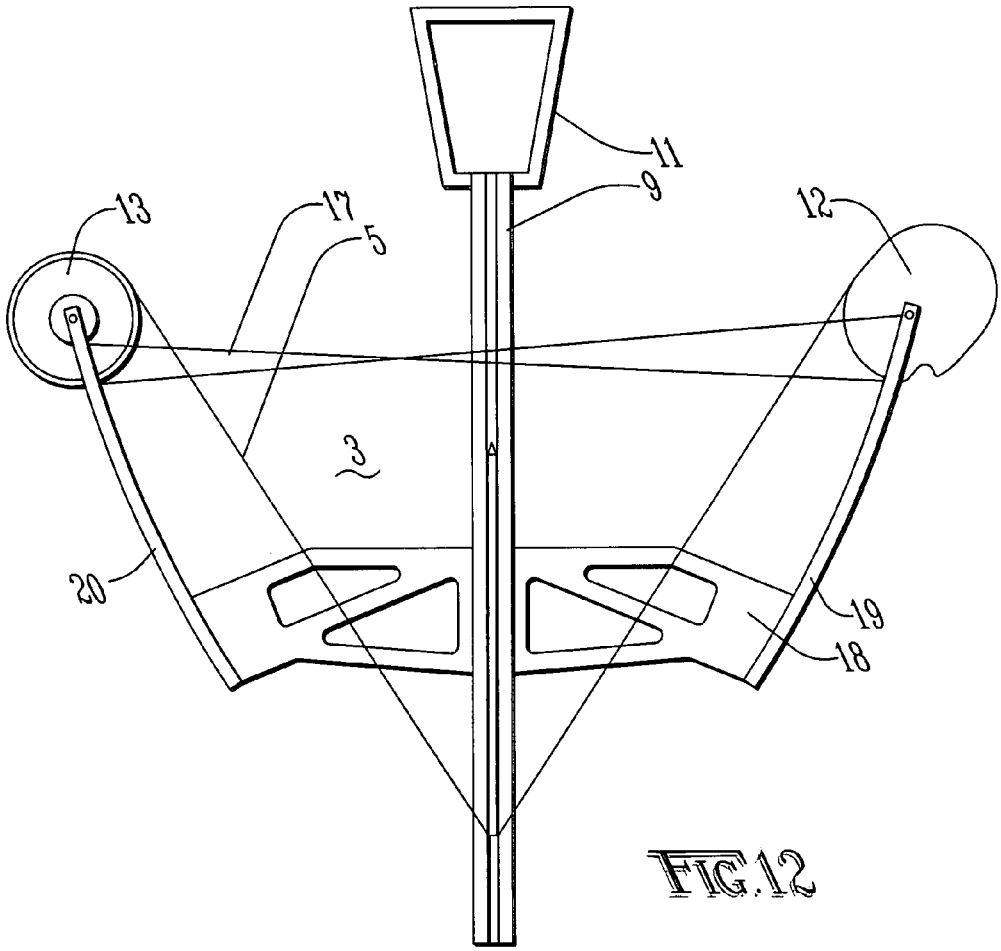
FIG. 12 is a partial top view of the current invention in the ready-to-fire position, with the projectile located along the rail and engaged to the bowstring at a point rearward of the riser.
Figure 13:
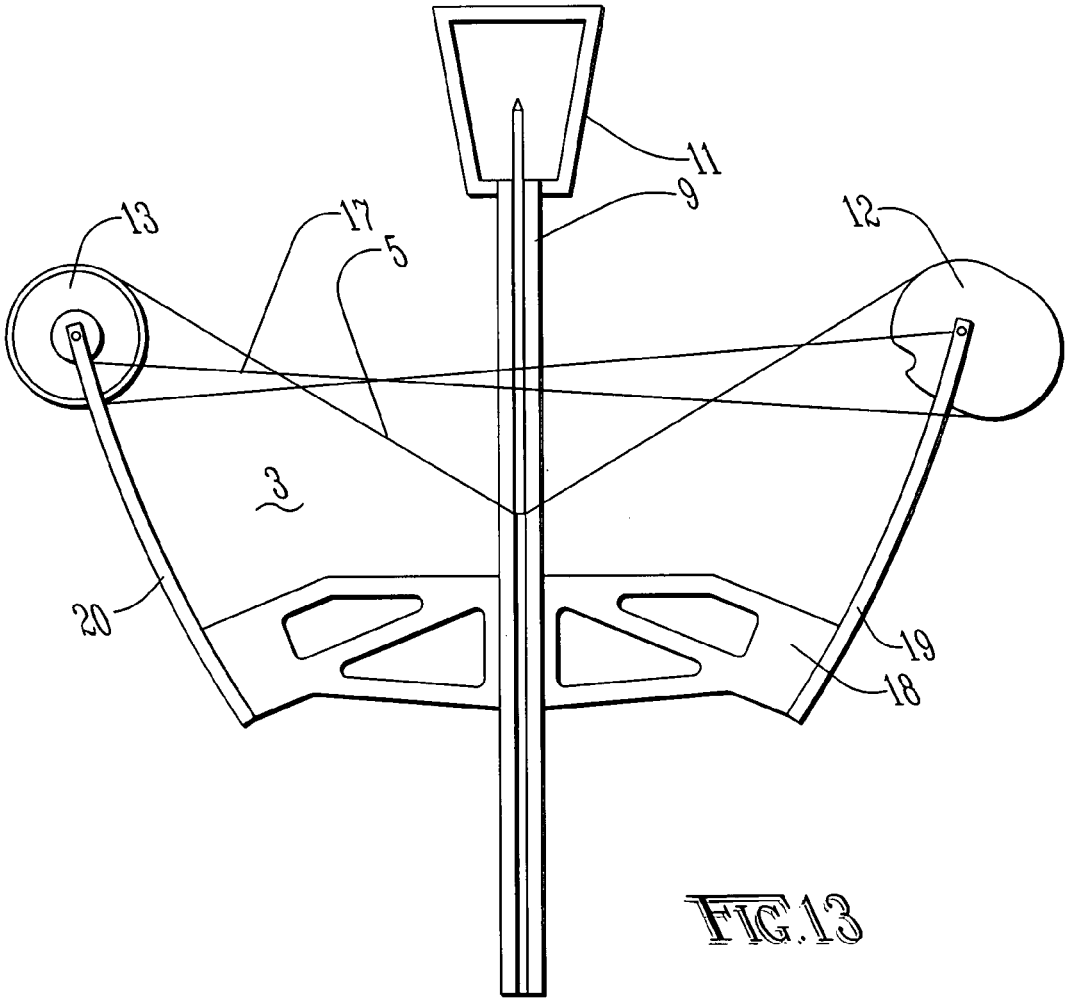
FIG. 13 is a partial top view of the current invention as the current invention is being fired. The projectile has moved partially down the rail and is engaged with the bowstring at a point rearward of the cam and wheel, and forward of the riser.

FIGS. 12 and 13 are partial top views of the current invention, shown with the invention in the ready-to-fire position with a projectile located along the rail, and the invention being fired, respectively.

I claim:

1. A bow comprising:

a) a riser;

b) a first limb extending at least partially outward from said riser;

c) a second limb extending at least partially forward and outward from said riser;

d) a first string guide journaled to said first limb at a first point, wherein said first string guide is a cam;

e) a second string guide journaled to said second limb at a second point;

f) a string extending between said first string guide and said second string guide; and g) a projectile engaged to said string on a side of said riser opposite a side of said riser where said first string guide and said second string guide are located.

2. The bow of claim 1, wherein said bow is a crossbow.

3. The bow of claim 2, further comprising a latch and trigger assembly operably coupled to said string.

* * * * *